US005397533A

United States Patent [19]

Morikawa et al.

[11] Patent Number: 5,397,533

[45] Date of Patent: Mar. 14, 1995

[54] PROCESS FOR PRODUCING $TiB_2$-DISPERSED TIAL-BASED COMPOSITE MATERIAL

[75] Inventors: Takashi Morikawa; Hiroyuki Shamoto, both of Toyota; Tetsuya Suganuma, Nagoya, all of Japan

[73] Assignee: Toyota Jidosha Kabushiki Kaisha, Toyota, Japan

[21] Appl. No.: 85,080

[22] Filed: Jul. 2, 1993

[30] Foreign Application Priority Data

Jul. 3, 1992 [JP] Japan ..... 4-200334

[51] Int. Cl.[6] ..... C22C 14/00

[52] U.S. Cl. ..... 420/418; 148/421; 420/590

[58] Field of Search ..... 420/418, 590; 148/421

[56] References Cited

U.S. PATENT DOCUMENTS

| | | | |
|---|---|---|---|
| 3,037,857 | 6/1962 | Conant . | |
| 4,690,796 | 9/1987 | Paliwal . | |
| 4,710,348 | 12/1987 | Brupbacher et al. . | |
| 4,748,001 | 5/1988 | Banerji et al. . | |
| 4,751,048 | 6/1988 | Christodoulou et al. . | |
| 4,808,372 | 2/1989 | Koczak et al. . | |
| 4,915,902 | 4/1990 | Brupbacher et al. | 420/590 |
| 4,915,903 | 4/1990 | Brupbacher et al. | 420/590 |
| 4,915,905 | 4/1990 | Kampe et al. | 420/415 |
| 5,141,574 | 8/1992 | Takahashi et al. | 420/421 |

FOREIGN PATENT DOCUMENTS

| | | |
|---|---|---|
| 0113249 | 7/1984 | European Pat. Off. . |
| 0258510 | 3/1988 | European Pat. Off. . |
| 52-131911 | 11/1977 | Japan . |
| 3-193842 | 8/1991 | Japan . |
| WO90/01568 | 2/1990 | WIPO . |

*Primary Examiner*—Upendra Roy

*Attorney, Agent, or Firm*—Oblon, Spivak, McClelland, Maier, & Neustadt

[57] ABSTRACT

A TiAl intermetallic compound source and a boride which is less stable than $TiB_2$ are mixed and melted, followed by solidification to form a $TiB_2$-dispersed TiAl-based composite material in which the $TiB_2$ is contained in an amount of 0.3 to 10% by volume. In this process, the dispersed $TiB_2$ particles become very fine, so that the hardness as well as the elongation and bending strength of the TiAl material are improved by the finely dispersed $TiB_2$ particles.

7 Claims, 1 Drawing Sheet

PROCESS FOR PRODUCING $TiB_2$-DISPERSED TIAL-BASED COMPOSITE MATERIAL

BACKGROUND OF THE INVENTION

1. Field of the Invention

The present invention relates to a process for producing a $TiB_2$-dispersed TiAl-based composite material. More specifically, $TiB_2$ is uniformely dispersed in TiAl intermetallic compound-based matrix.

2. Description of the Related Art

The TiAl intermetallic compound is promising as a light-weight high temperature structural material since it has both metallic and ceramic properties, has a low density and has an excellent high temperature specific strength. The TiAl intermetallic compound is however limited in its applications since its hardness is low in comparison with normal metals and alloys.

To improve the hardness of the TiAl intermetallic compound, a TiAl-based composite material in which $TiB_2$ is dispersed was developed. For example, JP-A-03-193842, published in August, 1991, discloses a process for producing such a composite material, said process compressing mixing and melting powders of Al matrix containing $TiB_2$ dispersed therein, Al metal powders and Ti metal powders, followed by solidifying the same to form a TiAl intermetallic compound in which $TiB_2$ particles are dispersed.

As $TiB_2$ particles are dispersed in TiAl intermetallic compound, generally, the hardness of the TiAl intermetallic compound increases but the ductility thereof decreases. It is therefore necessary that $TiB_2$ particles are finely dispersed in the TiAl intermetallic compound. When the composite material is deformed, the matrix is deformed with cracks being formed. If the $TiB_2$ particles dispersed in the matrix are large, cracks are interrupted by the $TiB_2$ particles and the matrix cannot be deformed and is split or broken. In contrast, if the $TiB_2$ particles dispersed in the matrix are fine, cracks may develop through the gaps between the $TiB_2$ particles and the matrix can be deformed. Accordingly, it is considered that reduction of ductility of the matrix can be suppressed by finely dispersing $TiB_2$ particles in the matrix.

In the above mentioned process of producing a $TiB_2$-dispersed TiAl intermetallic compound-based composite material, however, it is difficult to finely disperse $TiB_2$ in a TiAl intermetallic compound since $TiB_2$ particles agglomerate with each other when the mixture of the $TiB_2$-dispersed Al powders, Al metallic powders and Ti metallic powders are melted.

The purpose of the present invention is to provide a process for producing a $TiB_2$-dispersed TiAl intermetallic compound-based composite material in which the dispersed $TiB_2$ is fine so that the reduction of the ductility of the material is suppressed while the hardness of the material is increased.

SUMMARY OF THE INVENTION

To attain the above and other objects of the present invention, there is provided a process for producing a $TiB_2$-dispersed TiAl-based composite material, comprising the steps of forming a molten mixture of a TiAl intermetallic compound source and a boride which is less stable than $TiB_2$, and cooling and solidifying said molten mixture to form a TiAl-based composite material in which $TiB_2$ is dispersed in an amount of 0.3 to 10% by volume of the composite material.

The TiAl intermetallic compound source may be a TiAl intermetallic compound itself, a mixture of Ti and Al metal powders, or a mixture of the compound and the powder mixture. The composition of the source is preferably such that Al is contained in an amount of 31 to 37% by weight of the total of Ti and Al.

The boride should be less stable than $TiB_2$. Since $TiB_2$ is generally most stable among metal borides, most metal borides may be used in the present invention. Such borides include, for example, $ZrB_2$, $NbB_2$, $TaB_2$, $MoB_2$, CrB, WB, VB and HfB.

The particle size of the boride to be mixed is not particularly limited but preferably less than 100 $\mu$m, more preferably 30 to 0.1 $\mu$m. If the particle size of the boride is larger than 30 $\mu$m, the time for decomposing the boride is elonged. If it is smaller than 0.1 $\mu$m, evaporation occurs during the melting step which reduces the yield.

The amount of the boride to be mixed is such that the obtained composite material will contain $TiB_2$ in an amount of 0.3 to 10% by volume, preferably 1 to 5% by volume, based on the composite material.

If the content of $TiB_2$ is less than 0.3% by volume, the hardness of the composite material is insufficient. If the content of $TiB_2$ is larger than 10% by volume, the ductility of the composite material is significantly lowered.

In the process for producing a $TiB_2$-dispersed TiAl intermetallic compound-based composite material of the present invention, a molten mixture of the TiAl intermetallic compound source and the boride is first formed. This molten mixture is typically formed by heating a powder mixture of the TiAl intermetallic compound source and the boride to a temperature of about 1550° to 1750° C. If the temperature is lower than 1550° C., it is difficult to obtain a uniform dispersion of $TiB_2$. If the temperature is higher than 1750° C., the yield of Al is lowered. Alternatively, it is possible that the TiAl intermetallic compound source be first heated to form a molten TiAl intermetallic compound source, followed by adding the boron particles into the molten TiAl intermetallic compound source.

The molten mixture is then cooled to room temperature. During the cooling, the molten TiAl intermetallic compound source becomes a TiAl intermetallic compound and the added boron, which is less stable than $TiB_2$, reacts with Ti of the molten TiAl intermetallic compound source to crystallize or deposite $TiB_2$ in the TiAl intermetallic compound matrix.

It is considered that the boride is dissolved and diffused in the molten Ti-Al. Since $TiB_2$ is the most stable boride in the presence of Ti, boron (B), which became very fine by dissolution and diffusion of the boride, reacts with Ti to crystallize or deposite $TiB_2$. This reaction to form $TiB_2$ occurs uniformly in the molten mass so that fine $TiB_2$ is formed uniformly in the TiAl intermetallic compound.

The particle size of $TiB_2$ in the composite material may be made to be not larger than 10 $\mu$m, further not larger than 5 $\mu$m.

Example 1

Figure 1:
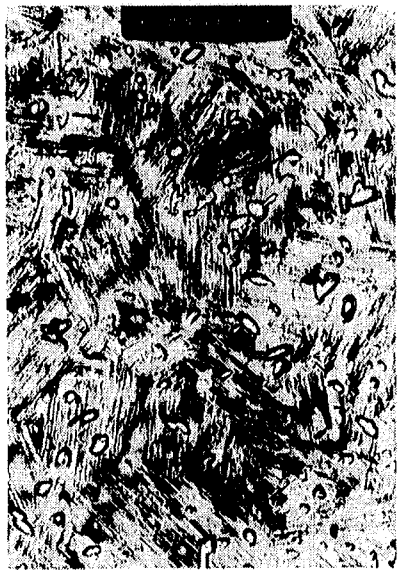
Fig. 1 PRIOR ART
FIG. 1 shows the microstructure of the $TiB_2$-dispersed TiAl-based composite material in Conventional Example 1 ($\times$100)

A mixture of a sponge Ti and an Al ingot in a weight ratio of Al/(Ti+Al) of 0.34 was mixed with $ZrB_2$ powders with an average particle size of 3 μm in an amount of 3% by volume based on the volume of the total Ti-Al. The thus obtained mixture was charged in a water-cooled copper crucible in an arc furnace and maintained in an argon atmosphere at a temperature between 1550° C. and 1750° C. for 10 minutes, followed by cooling in the crucible to produce a button ingot of a TiAl intermetallic compound matrix containing 2.52% by volume of $TiB_2$ dispersed therein.

Examples 2 to 8

The procedures of Example 1 were repeated, but the average particle size and amount of the boride to be mixed with the sponge Ti/Al ingot mixture were varied as shown in Table 1. The button ingots of a TiAl intermetallic compound matrix containing $TiB_2$ particles dispersed therein in an amount as shown in Table 1 were produced.

Comparative Example 1

The procedures of Example 1 were repeated but the mixture of a sponge Ti and an Al ingot in an Al/(Ti+Al) weight ratio of 0.34 was mixed with CrB powders with an average particle size of 30 μm in an amount of 0.2% by volume based on the volume of Ti-Al, to thereby obtain a button ingot of a TiAl intermetallic compound matrix containing 0.15% by volume of $TiB_2$ particles dispersed therein.

Comparative Example 2

The procedures of Comparative Example 1 were repeated but the CrB powders mixed with the Ti-Al was changed to 15% by volume.

Thus, a button ingot of a TiAl intermetallic compound matrix containing $TiB_2$ particles in an amount of 11.4% by volume was obtained.

Conventional Example 1

The procedures of Example 1 were repeated but the boride was changed to $TiB_2$ powders with an average particle size of 7 μm.

Thus, a button ingot of a TiAl intermetallic compound matrix containing 2.5% by volume of $TiB_2$ particles dispersed therein was obtained.

Conventional Example 2

A mixture of a sponge Ti and an Al ingot in a weight ratio of Al/(Al+Ti) of 0.34 was mixed with B powders and, in accordance with the procedures of Example 1, a button ingot of a TiAl intermetallic compound matrix containing 2.4% by volume of $TiB_2$ particles dispersed therein was obtained.

Conventional Example 3

A sponge Ti and an Al ingot were mixed in a weight ratio of Al/(Ti+A) of 0.34 and charged in a water-cooled copper crucible in an arc furnace, in which the mixture was maintained in an argon atmosphere at a temperature of 1600° to 1700° C. for 10 minutes and then cooled in the crucible to obtain a button ingot of a TiAl intermetallic compound.

Evaluations

Test pieces were cut from the button ingots of Examples 1 to 8, Comparative Examples 1 and 2, and Conventional Examples 1 to 3 and subjected to a Vickers hardness test and a bending test. The obtained hardness, elongation and bending strength of the test pieces are shown in Table 1.

$TiB_2$ was identified by X ray diffraction. The volume fraction of $TiB_2$ was determined by image analysis of micro structure of the composite.

TABLE 1

| | Additive | Average particle size of additive (μm) | Amount of additive | Amount of $TiB_2$ in TiAl-based composite material (vol %) | Hardness (HV) | Elongation (%) | Bending strength (MPa) |
|---|---|---|---|---|---|---|---|
| Example | | | | | | | |
| 1 | $ZrB_2$ | 3 | 3 vol % | 2.52 | 355 | 0.90 | 880 |
| 2 | $NbB_2$ | 3 | 3 vol % | 2.85 | 372 | 1.1 | 950 |
| 3 | $TaB_2$ | 3 | 3 vol % | 2.85 | 350 | 1.05 | 965 |
| 4 | MoB | 7 | 3 vol % | 1.83 | 370 | 1.3 | 981 |
| 5 | CrB | 30 | 0.5 vol % | 0.38 | 307 | 1.4 | 927 |
| 6 | CrB | 30 | 3 vol % | 2.28 | 347 | 1.35 | 920 |
| 7 | CrB | 30 | 10 vol % | 7.6 | 395 | 0.95 | 988 |
| 8 | CrB | 30 | 13 vol % | 9.8 | 415 | 0.70 | 890 |
| Comparative Example | | | | | | | |
| 1 | CrB | 30 | 0.2 vol % | 0.15 | 280 | 1.40 | 930 |
| 2 | CrB | 30 | 15 vol % | 11.4 | 420 | 0.20 | 650 |
| Conventional Example | | | | | | | |
| 1 | $TiB_2$ | 7 | 3 vol % | 2.5 | 351 | 0.55 | 779 |
| 2 | B | 3 | 3 at % | 2.4 | 355 | 0.45 | 750 |
| 3 | — | — | — | — | 269 | 1.42 | 938 |

Figure 2:
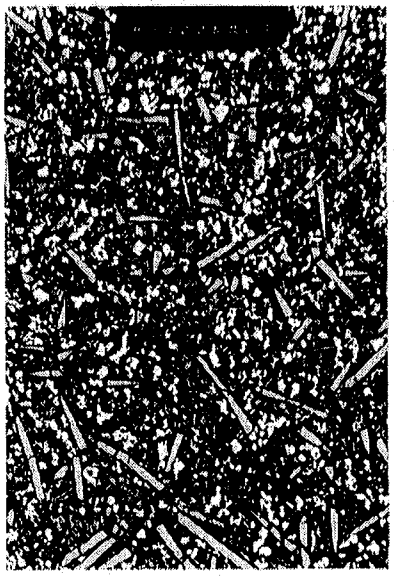
Fig. 2 PRIOR ART
FIG. 2 shows the $TiB_2$ powders used to prepare the composite material of FIG. 1 ($\times$100)

When the test pieces of Conventional Examples 1 and 2 in which $TiB_2$ particles were dispersed in a TiAl intermetallic compound matrix are compared with the test piece of Conventional Example 3 of a TiAl intermetallic compound, the test pieces of Conventional Examples 1 and 2 are superior in their hardness but inferior in their elongation and bending strength. It is considered that the above results are caused because the $TiB_2$ particles dispersed in the composite material are not fine. To confirm this, the microstructures of the test pieces of Conventional Example 1 and 2 were examined. FIG. 1 shows the microstructure of the test piece of Conventional Example 1 taken by microscope at a magnitude of 100. FIG. 2 shows the microstructure of the $TiB_2$ powders used for preparing the test piece of Conventional Example 1 at a magnitude of 100. From these microstructures, it becomes apparent that the particle size of the $TiB_2$ particles in the composite material in Conventional Example 1 increased from the 7 μm particle size of the original $TiB_2$ particles as mixed. A similar particle size increase was also found in the $TiB_2$ particles in Conventional Example 2. The reason for the increase of the $TiB_2$ particle size is thought because agglomeration of the $TiB_2$ particles.

The $TiB_2$-dispersed TiAl-based composite materials of Examples 1 to 8, i.e., produced in accordance with the process of the present invention, had improved elongation and bending strength in comparison with the test pieces of Conventional Examples 1 to 2, which are comparative to those of Conventional Example 3, and also had an excellent hardness. It is considered that the reason for the improved elongation and bending strength in Examples is because the particle size of the $TiB_2$ particles is finer. In the present invention, it is thought that the boride is dissolved and diffused in the molten Ti-Al, the free boron released from the decomposed boride reacts with Ti in the molten Ti-Al to form $TiB_2$, which is the most stable boride in the presence of Ti, and thus crystallizes or deposits fine $TiB_2$.

Figure 3:
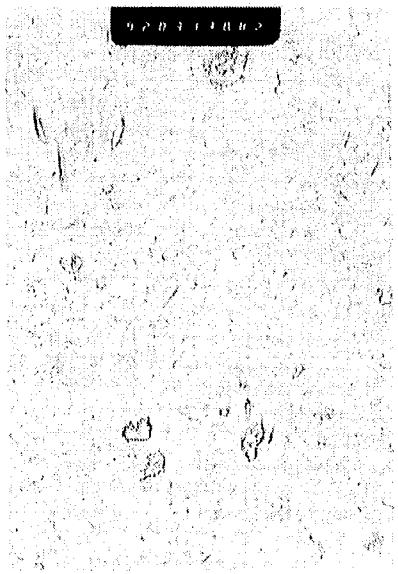
FIG. 3 shows the microstructure of the $TiB_2$-dispersed TiAl-based composite material in Example 6 (×100).

The microstructure of the test pieces of the Examples was examined. FIG. 3 shows the microstructure of the test piece of Example 6 taken by a microscope at a magnitude of 100. It is seen that the particle size of the $TiB_2$ particles ranges from the submicrons size to a few micro meters, that is, very fine. In other Examples, the particles sizes of the $TiB_2$ particles were found to be in the ranges from submicrons to a few micro meters.

It is thought that the elements other than B, such as Zr, Nb, Ta, Mo and Co, constituting the boride, are solid solved in the TiAl intermetallic compound and contribute to the improvement of the extension and hardness of the TiAl composite materials.

It is seen from Comparative Example 1 that if the content of the dispersed $TiB_2$ in the composite material is less than 0.3% by volume, an improved hardness i.e., a desired effect of dispersing the $TiB_2$ particles cannot be obtained. It is seen from Comparative Example 2 that if the content of the $TiB_2$ particles is more than 10% by volume, the hardness of the composite material is improved but the elongation and bending strength of the composite material are significantly decreased. The reason for the significant decrease of the elongation and bending strength of the composite material is thought to be because of portion of the boride particles cannot be dissolved and remain as large particles.

Accordingly, it is seen that the $TiB_2$ content of the $TiB_2$-dispersed TiAl-based composite material of the instant invention should be in a range of 0.3 to 10% by volume.

We claim:

1. A process for producing a $TiB_2$-dispersed TiAl-based composite material, comprising the steps of:

forming a molten mixture of a TiAl intermetallic compound source and at least one boride which is less stable than $TiB_2$ selected from the group consisting of $ZrB_2$, $NbB_2$, $MoB_2$, CrB, WB, VB and HfB, and cooling and solidifying said molten mixture to form a TiAl-based composite material in which $TiB_2$ is dispersed in an amount of 0.3 to 10% by volume of the composite material.

2. A process according to claim 1, wherein said boride has an average particle size of 100 to 0.1 μm.

3. A process according to claim 1, wherein said TiAl intermetallic compound source is a mixture of Ti and Al metal particles, the Al metal particles being in an amount of 31 to 37% by weight of the total of the Ti and Al metal particles.

4. A process according to claim 1, wherein said TiAl intermetallic compound source includes a TiAl intermetallic compound.

5. A process according to claim 1, wherein said boride is added in such an amount that the obtained TiAl-based composite material contains 1 to 5% by volume of the dispersed $TiB_2$.

6. A process according to claim 1, wherein said molten mixture is heated up to a temperature of 1550° C. to 1750° C.

7. A process according to claim 1, wherein said $TiB_2$ dispersed in said TiAl-based composite material has a particle size of less than 10 μm.

* * * * *